United States Patent [19]

Mallory et al.

[11] 4,136,747

[45] Jan. 30, 1979

[54] METHOD AND MEANS FOR REDUCTION OF OXYGEN CONTENT IN DRILLING FLUID

[75] Inventors: Harvey E. Mallory, Tulsa, Okla.; James W. Ward, Riqua, United Arab Emirates

[73] Assignee: Loffland Brothers Company, Tulsa, Okla.

[21] Appl. No.: 751,255

[22] Filed: Dec. 17, 1976

[51] Int. Cl.[2] ..... E21C 21/00

[52] U.S. Cl. ..... 175/66; 55/53; 55/196; 175/206; 175/69

[58] Field of Search ..... 175/66, 69, 206; 166/244 C; 21/2.7; 55/36, 37, 47, 52, 53, 54, 196

[56] References Cited

U.S. PATENT DOCUMENTS

| | | | |
|---|---|---|---|
| 2,338,174 | 1/1944 | Garrison | 175/206 X |
| 3,276,966 | 10/1966 | Talbot | 209/17 |
| 3,286,778 | 11/1966 | Jackson | 175/69 |
| 3,301,323 | 1/1967 | Parsons | 166/244 C X |

FOREIGN PATENT DOCUMENTS

| | | | |
|---|---|---|---|
| 576953 | 6/1959 | Canada | 166/244 C |

*Primary Examiner*—Ernest R. Purser
*Attorney, Agent, or Firm*—Head, Johnson & Chafin

[57] ABSTRACT

A method and means for using nitrogen exhaust gases or gaseous mixtures of combustible products for reduction of oxygen in drilling fluids during the drilling of well bores and which comprises utilizing nitrogen from normally waste exhaust gases or the like, injecting the nitrogen and other gases present into the usual drilling muds for replacing the oxygen contents of the drilling muds with the nitrogen gas, whereby corrosive action of the drilling muds is greatly reduced or substantially eliminated.

8 Claims, 5 Drawing Figures

METHOD AND MEANS FOR REDUCTION OF OXYGEN CONTENT IN DRILLING FLUID

BACKGROUND OF THE INVENTION

1. Field of the Invention

This invention relates to improvements in well bore drilling method and means and more particularly, but not by way of limitation, to a well bore drilling method and means whereby oxygen content of well drilling muds is replaced by nitrogen, exhaust gases, or gaseous mixtures of combustible products for reduction of corrosion.

2. Description of the Prior Art

In the drilling of an oil or gas well, the drilling operation normally comprises the piercing of the earth by means of a drill bit carried at the lower end of a string of drill pipe. The drill bit penetrates the earth to create the well bore, and the drill string is continually lengthened during the drilling process as the bit cuts or drills deeper into the earth.

One drilling method in widespread use today utilizes a drilling fluid for facilitating the drilling operation performed by the drill bit. The drilling fluid is usually circulated downwardly through the drill pipe to the drill bit for flushing or washing away cuttings and other debris from the bottom of the well bore which might hinder the operation of the bit. The drilling fluid and cuttings and/or particles is then pumped upwardly in the well bore through the annulus between the outer periphery of the drill pipe and the walls of the well bore and to the surface of the earth where the drilling fluid is directed into the mud pits normally provided in the proximity of the well bore for storage of the fluid in order that the fluids may be reused. The mud pits are normally open storage pits, and the fluid retained therein is frequently contaminated by the oxygen present in the atmosphere adjacent the exposed upper surface of the stored mud. In addition, oxygen may contaminate the drilling fluids during mixing thereof and during removal of cuttings and the like from the circulated fluids. Of course, oxygen in the drilling fluids is a great disadvantage in that the circulation of the fluids in the well bore brings the drilling fluid into intimate contact with substantially the entire inner and outer peripheries of the drill pipe as well as the drill bit, and the oxygen in the drilling fluids causes corrosion of any metallic equipment with which it is in contact. Because of the current use of polymer-type drilling fluids utilizing the salts of sodium and potassium, the problem of corrosion is greatly increased in the presence of oxygen, making it more necessary than ever to reduce or eliminate the oxygen content of the drilling fluids.

Various chemicals are frequently used to react with and remove the dissolved or entrained oxygen in the drilling fluids and are somewhat effective in the alleviation of the corrosive condition that occurs, especially on the inner periphery of the drill pipe. However, any oxygen contained in the drilling fluid is a disadvantage, and any corrosion of the drill pipe is extremely disadvantageous, particularly in the light of the present-day costs and scarcity of materials.

There is also increasing demand for delivery of coal and the like through pipelines, and movement of materials in this manner requires a slurry in combination with the materials for passing thereof through the pipeline. Water is normally used in the slurry, and the oxygen content of the slurry increases the corrosion problem of the inner periphery of the pipe.

SUMMARY OF THE INVENTION

The present invention contemplates a method and means for removing substantially all of the oxygen content from the drilling fluids utilized in the well bore drilling operation. Nitrogen, or any other suitable gas or mixture of gases, is injected into the drilling fluids in a manner for replacing any oxygen in the fluids. The gas may be injected into the fluid in any suitable manner, such as, injected into the fluids at a suitably vented station upstream of the pump suction, such as a vented tank, degasifier, or other vessel, and may not be utilized not only for the removal of oxygen, but also to reduce or possibly eliminate the use of other chemicals in connection with the drilling fluids. Another method or embodiment of the invention is to inject the gas directly into the mud pits.

Nitrogen is perhaps the preferable gas to inject into the drilling fluids in that it is plentiful and readily available. The present method contemplates utilizing the nitrogen from the exhaust gases of the normal equipment, such as engines and the like, gaseous mixtures obtained by combination or the like, present at the well drilling site, and injecting the exhaust gases or the like into the drilling fluids through a degasser interposed between the exhaust system of the engines and the suction side of the drilling mud pumping equipment. The exhaust gases of engines using either natural gas or diesel fuel is substantially eightyseven percent nitrogen, and thus it will be apparent that substantially all types of exhaust gases are usable with the present invention. Of course, nitrogen gas or the like, in and of itself may be utilized in the practice of this invention. In addition, the exhaust gases may be directly injected from an engine or a combustion chamber into the mud pits.

It is expected that perhaps 1,000 to 5,000 cubic feet of nitrogen will be used per hour during a typical well drilling operation in the practice of the present invention; and as hereinbefore set forth, since nearly all of the exhaust gases are useable as nitrogen, a plentiful supply of normally waste product is usually available at each well site. The exhaust gas is preferably directed from the exhaust manifold of the engine into a filter section of a degasser, or the like, but not limited thereto. The exhaust gas passes downwardly through the filter section and into a passageway for discharge into a liquid bath, where the exhaust gas "bubbles upwardly" through the liquid for withdrawal from the degasser through a riser connected with the suction side of a suitable compressor. Any debris or foreign particles present in the exhaust gas are removed through this process, and substantially clean exhaust gas is directed from the compressor through a suitable flow meter for injection into the drilling fluids.

The nitrogen present in the exhaust gas is introduced into the drilling fluids by injection of the nitrogen into the reservoir of the drilling fluid, through suitable perforated pipes and the like disposed within the reservoir and surrounded by the drilling mud. In addition, a nitrogen atmosphere is created adjacent the exposed upper surface of the drilling mud during the circulation process of the drilling mud in order to reduce or substantially eliminate contamination of the drilling fluids by exposure to the ambient air. The nitrogen injected into the drilling fluids replaces the oxygen in the drilling fluid; and not only is the oxygen content of the drilling fluid substantially eliminated or reduced to minute quantities, as for example ½ part per million or less, for substantially eliminating corrosion of the drill pipe and other metallic elements used in the drilling operation, but also gases which are normally wasted are recovered for use, and the venting of engine exhaust gases into the atmosphere is greatly reduced for reducing environmental hazards. It is also considered that the nitrogen injected into the drilling fluids may reduce the catalytic effect the oxygen would have on hydrogen sufide which may be present in the drilling fluids, thus further reducing any corrosive action.

The same principle of replacing oxygen in fluids by nitrogen for reduction of corrosion may be applied to the slurry used in pipelines wherein coal or the like is being transported therethrough.

As an example of the practice of the invention in combination with substantially any combustion chamber producing suitable exhaust gases, it is anticipated that the exhaust gases from the combustion chamber may be directed through a suitable heater for assuring a sufficiently high temperature for the gases. From the heater, the gases may be directed through a suitable catalytic converter and into a water bath or scrubber for cleaning of the gas stream, and incidentally reducing the oxygen content of the water in the bath. If desired, the gas stream may be directed through a filter prior to passage through the water bath in order to remove carbon dioxide, carbon monoxide, hydrocarbons, and the like, from the gas stream. The cleaned gas from the water bath or scrubber may then be utilized as an additive to the steam injection fluids or may be directed into the drilling fluids as hereinbefore set forth.

DESCRIPTION OF THE PREFERRED EMBODIMENTS

Figure 2:
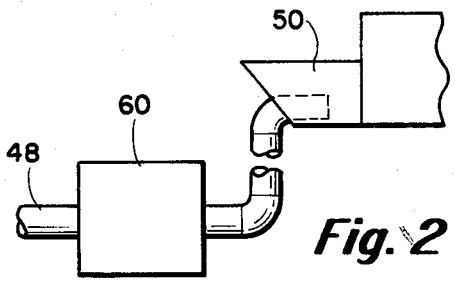
FIG. 2 is a broken elevational view of a modified embodiment of a portion of the unit depicted in FIG. 1.
Figure 1:
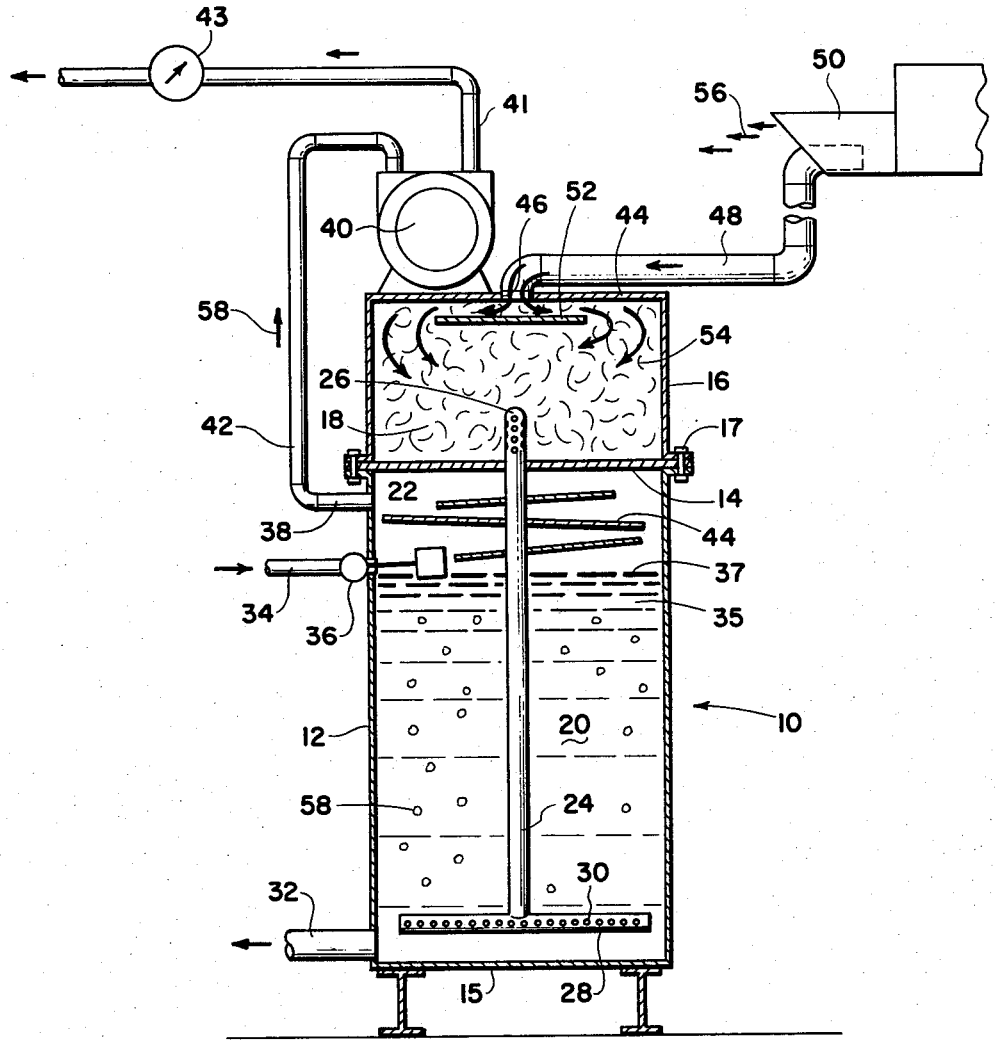
FIG. 1 is a sectional elevational view of a gas processing unit such as may be used in the invention.

Referring to the drawings in detail and particularly FIG. 1, reference character 10 generally indicates a gas processing unit comprising a first housing 12 having the upper end thereof closed by a suitable plate member 14 and the lower end thereof closed by a suitable bottom 15. A second housing 16 is secured to the housing 12 above the plate 14 in any suitable manner, such as by bolts 17, thereby providing chambers 18 and 20 on opposite sides of the plate 14. The plate 14 is provided with a central aperture 22 having a standpipe 24 extending therethrough. The closed upper end of the pipe 24 extends into the chamber 18 and is provided with a plurality of spaced apertures 26 which provide communication between the interior of the pipe 24 and the chamber 18. The lower end of the pipe 24 terminates in the proximity of the lower portion of the chamber 20, and a transversely extending pipe 28 is suitably secured to the lower end of the pipe 24 as shown in FIG. 1. The pipe 28 is provided with a plurality of spaced apertures 30 providing communication between the interior of the pipe 28 and the chamber 20.

A first discharge port 32 is provided in the lower portion of the housing 12 and is preferably in communication with a suitable pump (not shown) for a purpose as will be hereinafter set forth. An inlet port 34 is provided in the housing 12 spaced upwardly from the port 32 and preferably extends into communication with a liquid reservoir (not shown) for admitting liquid 35 into the chamber 20. A suitable float valve 36 is preferably interposed in the inlet 34 and extends into the chamber 20 for control of the level 37 of the liquid 35 in a manner and for a purpose as will be hereinafter set forth. A second discharge port 38 is provided in the upper portion of the housing 12 spaced above the inlet port 34 and is in communication with the suction side of a suitable compressor 40 through a conduit 42. The discharge side of the compressor 40 is in communication with a conduit 41 preferably having a float meter 43 interposed therein for discharging gas from the compressor. A plurality of angularly disposed longitudinally spaced baffles 44 are carried by the pipe 24 and disposed in the upper portion of the chamber 20 above the level 37 for a purpose as will be hereinafter set forth.

The upper end of the housing 16 is closed by a suitable cover 44 which is provided with a centrally disposed aperture 46 providing access to the chamber 18. Suitable conduit means 48 extends from the aperture 46 to the usual exhaust muffler 50 of a suitable engine (not shown) for directing the exhaust gases from the muffler 50 into the chamber 18. A baffle or spreader plate 52 is preferably secured within the chamber 18 in any suitable manner (not shown) and is spaced slightly downwardly from the aperture 46 for initially receiving the exhaust gases thereagainst for a purpose as will be hereinafter set forth. The chamber 18 is preferably filled with a suitable filter material 54, such as steel wool, or the like.

When the compressor 40 is activated in the usual manner, a suction is created through the apparatus 10 and in the conduit 48 whereby the exhaust gases moving from the exhaust muffler 50 in the direction of the arrows 56 will be drawn into the pipe or conduit 48. The exhaust gases are discharged into the chamber 18 through the port 46 whereupon they initially impinge upon the baffle or spreader plate 52. The gases are thus discharged into substantially the entire cross-sectional area of the chamber 18 and move radially and longitudinally through the filter material 54 and through the perforations 26 into the interior of the pipe 24. The filtered gases them move downwardly through the pipe 24 and into the perforated pipe 20 and outwardly through the perforations 30 for discharge into the liquid 35 contained within the chamber 20. The liquid 35 is preferably water, but not limited thereto; and since the filtered gases are of lighter weight than the water 35, the filtered gases bubble upwardly through the water 38 as indicated at 58, and accumulate in the upper portion of the chamber 20 above the level 37 of the liquid 35.

The filter material 54 and liquid 35 remove substantially all of the debris or foreign particles which may be contained in the exhaust gas. However, the baffles 44 agitate the flow of the gases moving from the liquid bath 35 toward the discharge port 38 in the chamber 20 and "knocks out" any water particles, or any other particles which might remain in the gaseous stream. Thus, substantially clean exhaust gases are drawn upwardly through the conduit 42 in the direction indicated by the arrow 58 for passing through the compressor 40. As hereinbefore set forth, substantially eighty seven percent of the exhaust gas is nitrogen, and the remaining components of the gaseous stream are readily absorbed or precipitated out of the drilling mud through the normal reaction therebetween.

The float valve functions in the usual or well-known manner in response to fluctuations of the position of the water level 37 in the chamber 20 for maintaining the level 37 at the desired position. The discharge port 32 may be utilized in the usual or well-known manner for discharge or draining of the water 35 from the chamber 20 as desired or necessary.

The exhaust gases being emitted from the muffler 50 are normally at a relatively high temperature. However, if it may be desirable to increase the heat of the exhaust gases, a suitable heater 60 may be provided for the conduit 48 and disposed between the muffler 50 and the inlet port 46. The heater 60 is preferably an electric heater, but not limited thereto, and may be utilized as required for supplying heat to the gases moving through the conduit 48.

Figure 3:
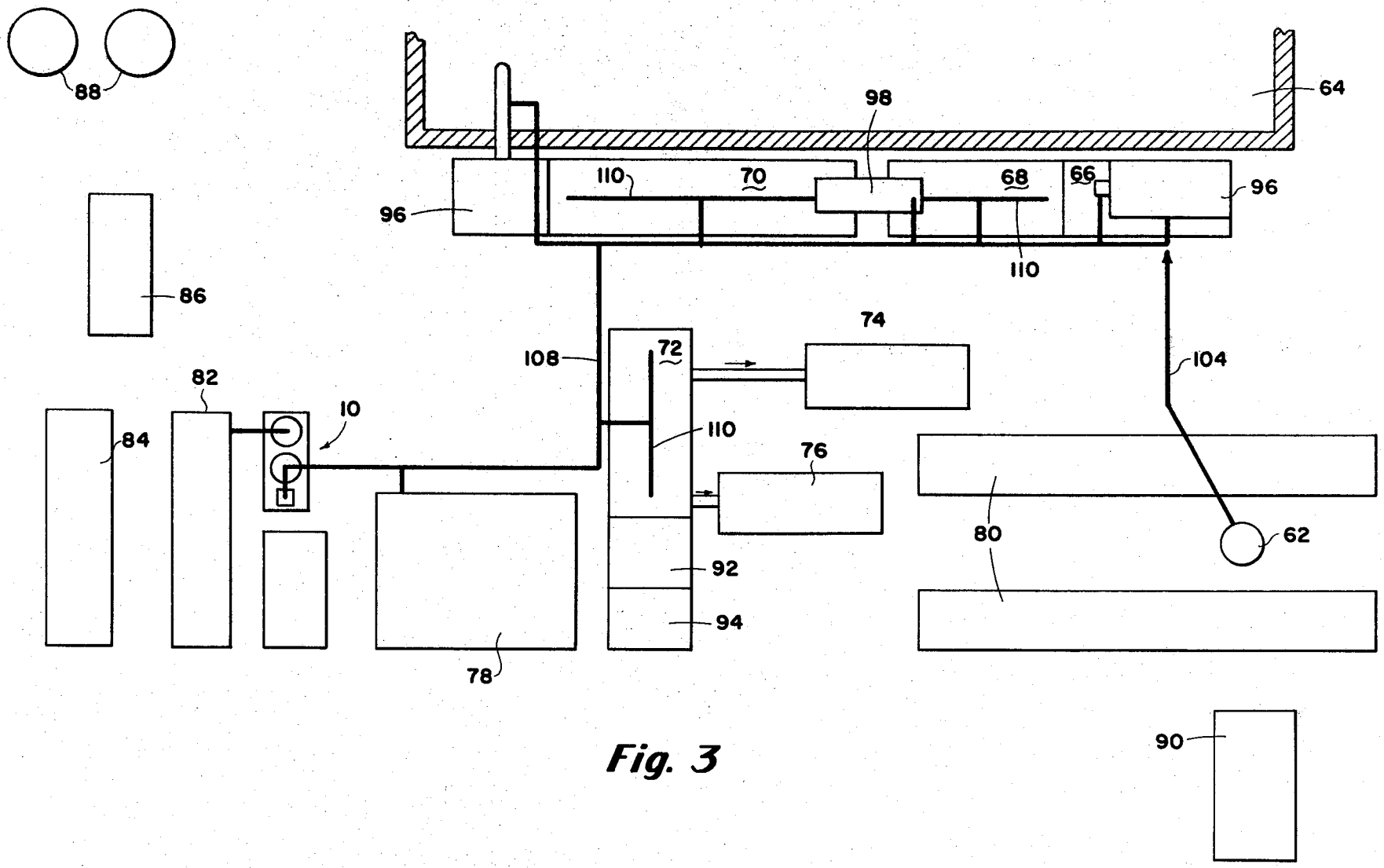
FIG. 3 is a schematic plan view of a typical arrangement of equipment at an oil or gas well drilling site and illustrates a method of exhaust gas injection in the drilling fluid which embodies the invention.
Figure 4:
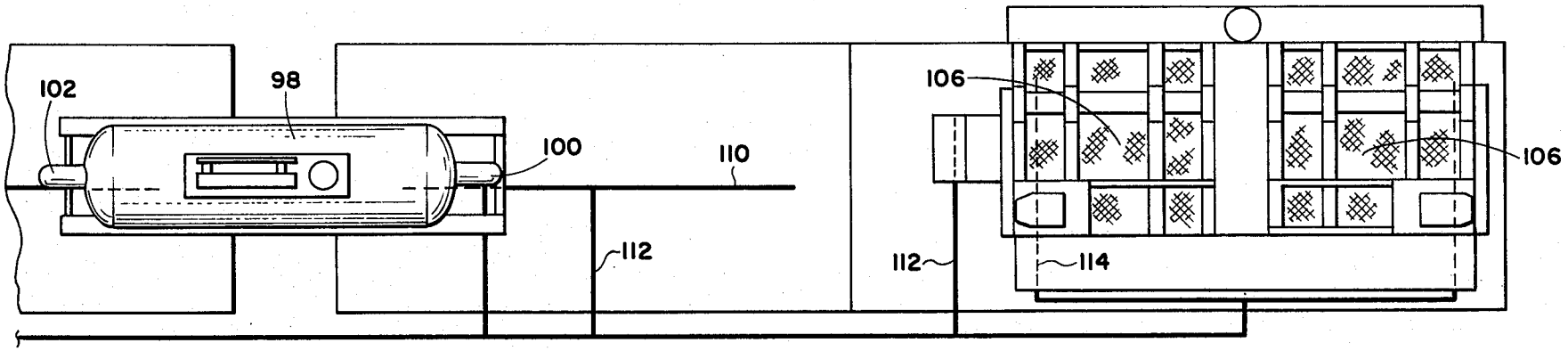
FIG. 4 is an enlarged plan view of a portion of the equipment and method shown in FIG. 3.
Figure 5:
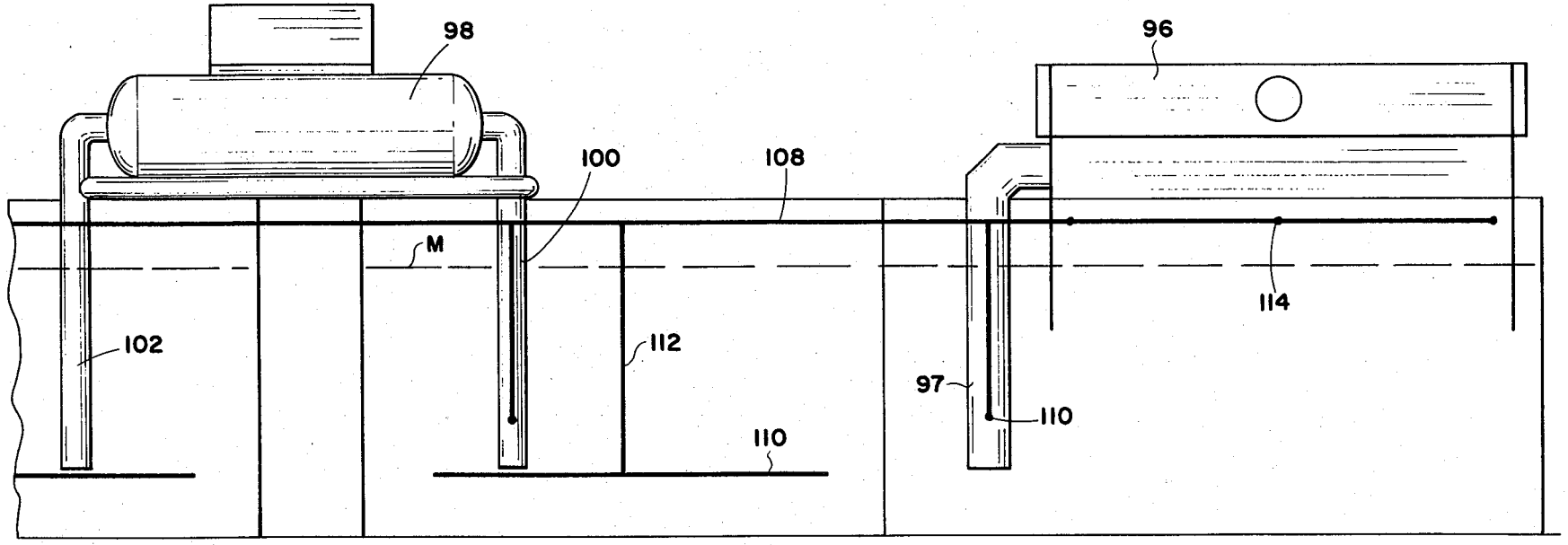
FIG. 5 is a schematic elevational view of the portion of the method and means shown in FIG. 4.

Referring now to FIGS. 3, 4, and 5, a typical installation at the drilling site of a well bore 62 is illustrated which comprises a reserve pit 64 disposed in the proximity of the well bore 64 for storage of a quantity of drilling fluid (not shown) to be used during the well drilling operation. A plurality of mud pits, such as shown at 66, 68, 70, and 72 are provided in the general area of the reserve pit 64, for receiving and storing quantities of the drilling mud or fluid during the drilling operation, all of which is well-known in the industry. Normally, the pits 66 and 68 are in communication through suitable by-pass conduits (not shown), and the pits 68 and 70 are similarly in communication through suitable by-pass conduits (not shown), as are the pits 70 and 72. Thus, substantially any necessary quantity of drilling mud is readily available at all times during the drilling operations for meeting all drilling requirements. Suitable mud pumps 74 and 76 are provided in communication with the mud pit 72 for directing the mud or drilling fluids therefrom into the drill pipe for circulation downwardly therethrough to the bottom of the well bore. A mud house 78 is provided in the vicinity of the well bore 62 for storing the sack of dry chemicals from which the drilling mud is made, and a hopper or the like (not shown) is preferably provided for directing preselected quantities of the dry ingredients to the mud pits for mixing with suitable liquids to produce the desired drilling mud product, as is well known. A suitable substructure 80 is also provided in the proximity of the well bore 62 for supporting the usual operating equipment necessary for the performance of the drilling operation. In addition, a power plant 82, boiler house 84, heater 86, fuel storage tank 88, and water tank 90 are provided at the well bore site. A sludge tank 92 and pumps 92 and 94 are provided in the proximity of the mud pit 72, and a pump 96 is provided in the proximity of the reserve pits 64 and 70. A suitable shaker 96 is disposed above the mud pit 66 and in communication therewith through a conduit or pipe 97. A suitable degasser unit is disposed above the pits 68 and 70 and is in communication with each through conduits 100 and 102.

During the well bore drilling operation, the proper quantity and quality drilling fluid is pumped downwardly through the center of the drill pipe (not shown) by directing the fluid through suitable flexible tubing (not shown) which extends over the pulley (not shown) of the drilling rig (not shown). The drilling fluid is pumped downwardly through the drill pipe to the bottom of the well bore 62 and is returned or recirculated upwardly through the annulus between the outer periphery of the drill pipe and the wall of the well bore. The returning drilling fluid or drilling mud contains debris washed from the bottom of the well, and is normally contaminated with gas absorbed or "picked up" by the drilling mud during the recirculating operation. The returning drilling fluid is directed from the annulus of the well bore 62 to the shaker 96 through suitable piping, as indicated at 104 in FIG. 3. The shaker 96 normally includes screens 106 (FIG. 4), and the agitation of the drilling mud by the shaker 96 causes cuttings, debris, or other foreign particles to fall out of the drilling mud onto the screens by gravity, thus partially cleaning the drilling mud. The mud leaves the shaker 96 through the conduit 97 and falls by gravity into the pit 66. In the event the mud in pit 66 is considered to be in condition for reuse, it may be recirculated downwardly through the drill string as required. However, in most instances, the drilling mud is passed from the pit 66 into the pit 68 by the usual by-pass line or pipe (not shown), and is drawn into the degasser unit 98 by the suction of the normal compressor or pump (not shown) provided in combination therewith. The mud passes through the degasser 98 where the fluid is properly treated for removal of substantially any entrained gases "picked up" during the recirculation of the fluid through the well bore 62, and the degassed fluid is deposited in the pit 70, from where it may be passed to the pit 72 by the usual by-pass line (not shown), and from where the mud may be returned to the drill string for additional use, all of which is well known in the art.

In the practice of the present invention, the nitrogen generator or nitrogen source 10 is suitably connected with the mud pits 66, 68, 70, and 72 through suitable conduits or piping system generally indicated at 108 in FIGS. 3, 4, and 5, and which is in communication with the conduit 41 for receiving the exhaust gases therefrom. The piping system 108 is connected with suitable perforated pipes 110 by suitable branch lines 112. The perforated pipes 110 are disposed within the mud pits and preferably in the lower portion thereof, whereby the pipes 110 will be surrounded by the drilling mud. In addition, suitable perforated pipes 114, as shown in FIGS. 4 and 5, are in communication with the piping system 108 and are disposed below the screens 106 of of the shaker 96 for providing a nitrogen atmosphere in the shaker in order to insulate the mud therein from the ambient air in order to reduce contact of the drilling mud with the oxygen in the ambient air.

The exhaust gases leaving the apparatus 10 through the conduit 41 are directed to the plurality of perforated pipes 110 and 114, whereby the nitrogen content of the exhaust gases is injected directly into the mud contained in the pits 66, 68, 70, and 72. At the same time, of course, the nitrogen atmosphere is created below the screens 106 of the shaker. The nitrogen contained in the exhaust gases replaces the oxygen in the drilling mud and forces the oxygen upwardly through the mud for escape through the exposed upper surface thereof. In addition, any excess quantity of nitrogen injected into the mud will bubble upwardly through the mud for discharge at the exposed upper surface thereof; and it has been found that the escaping nitrogen accumulates over the entire exposed surface of the drilling mud, forming a protection layer of nitrogen between the exposed drilling mud and the ambient air. Thus, contamination of the drilling bit by contact with the oxygen in the air is substantially eliminated.

Testing procedures using the method of the invention indicate that the nitrogen injected into the drilling mud may act as a dispersant, at least it appears to offer a slight dispersing action. This may be due to the removal of the entrained air or oxygen. Of course, it is to be understood that substantially any suitable gases may be utilized in the practice of the present invention with substantially the same results. However, the use of nitrogen present in the exhaust gases of equipment normally present at a well bore drilling site offers other advantages; namely, the reduction of contaminates discharged into the atmosphere.

As hereinbefore set forth, it has also been found that hydrogen sulfide appears to be driven off or removed from the drilling fluid along with the oxygen, thereby removing another possible source of corrosion of downhole drilling equipment.

Experiments have been conducted wherein the injection of nitrogen into the drilling fluids during the drilling of a well bore have been documented. In the drilling of one particular well bore, the injection of nitrogen was initiated for testing purposes subsequent to some drilling under "normal" or "standard" mud drilling operation, and the results indicated a remarkable drop in oxygen content in the drilling fluids, along with a corresponding drop in the corrosion rate. For example, the oxygen content of the drilling mud dropped from approximately 5 and 6 parts per million to approximately 0.5 to 1.7 parts per million upon the injection of the nitrogen into the drilling muds. Subsequent testing programs have produced equally remarkable results.

From the foregoing, it will be apparent that the present invention provides a novel method and means for drilling oil and/or gas well bores wherein corrosion of the drilling equipment is greatly reduced. A suitable gas is injected into the normal drilling fluids for replacing substantially all of the oxygen content of the drilling fluids, thus substantially eliminating or greatly reducing corrosion resulting from the drilling fluid contact with the drill pipe, drill bit, or other metallic "down hole" tools or equipment. It is a particular advantage to use nitrogen as the gas in the practice of the invention since a plentiful supply of nitrogen is usually readily available at the well drilling site in that content of the exhaust gases of the engines, and the like, utilized during the well drilling operation is largely nitrogen, and these exhaust gases may be "cleaned" for injection into the drilling muds for injection of the nitrogen into the muds for replacement of the entrained oxygen. The novel method and means not only reduces corrosion but also utilizes gases which are normally waste products, and utilizes these gases in a manner for reducing contamination of the atmosphere, thus improving the natural environment surrounding the drilling site. The novel method and means is simple and efficient in operation and economical and durable in construction.

Whereas the present invention has been described in particular relation to the drawings attached hereto, it should be understood that other and further modifications, apart from those shown or suggested herein may be made within the spirit and scope of this invention.

What is claimed is:

1. A method for drilling a well bore using drilling fluids and which comprises the displacement of substantially all of the oxygen in the drilling fluid with a suitable inert gas for reduction of corrosion in the drilling operation, and providing an atmosphere of the inert gas adjacent substantially any exposed surface of said drilling fluids for reducing contamination of the drilling fluids from the oxygen content of the ambient air.

2. A method as set forth in claim 1 wherein the gas is nitrogen.

3. A method as set forth in claim 1 wherein the gas is recovered from normally wasted exhaust gases from natural gas, gasoline, or diesel burning engines.

4. A method as set forth in claim 1 wherein the gas is recovered from combustible products.

5. A method for drilling a wall bore using drilling fluids and which comprises cleaning the exhaust gases from combustible products for removal of debris therefrom, directing said cleaned gases into the drilling mud reservoirs, injecting the cleaned gas directly into said drilling fluids whereby the nitrogen components of the gases replaces the oxygen content of the drilling fluid for substantially eliminating the oxygen content of the drilling fluids, and wherein the step of cleaning the exhaust gases comprises initially directing the exhaust gases into a filter chamber, dispersing the gases through the filter chamber for removal of debris from the gases, bubbling the filtered gases upwardly through a liquid bath for removal of additional debris, and knocking out any water or remaining debris from the gases leaving the liquid bath.

6. A method of reduction of oxygen content in fluids in contact with corrosive materials which comprises injecting suitable gases directly into the fluid for displacement of substantially all of the oxygen content of the fluid, and maintaining an atmosphere of said suitable gas adjacent any exposed surface of the fluids for precluding admission of additional oxygen content into the fluids.

7. A method as set forth in claim 6 wherein the gases are recovered from normally wasted exhaust gases from natural gas, gasoline, or diesel burning engines.

8. A method as set forth in claim 6 wherein the gases are recovered from combustible products.

* * * * *